US008002266B2

(12) United States Patent
Krause et al.

(10) Patent No.: US 8,002,266 B2
(45) Date of Patent: Aug. 23, 2011

(54) PICKOFF MECHANISM FOR MAIL FEEDER

(75) Inventors: Simon Jan Krause, Constance (DE); Bryan Stone, Dallas, TX (US); Edwin Bland, Mansfield, TX (US); John Day, Arlington, TX (US); Uwe Maertin, Euless, TX (US); Rajeev Dwivedi, Plano, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 73 days.

(21) Appl. No.: 12/186,122

(22) Filed: Aug. 5, 2008

(65) Prior Publication Data

US 2010/0034623 A1 Feb. 11, 2010

(51) Int. Cl.
*B65H 3/08* (2006.01)
*B65H 3/12* (2006.01)

(52) U.S. Cl. ..... 271/99; 271/94; 271/96; 271/98; 271/194; 271/12

(58) Field of Classification Search ..... 271/11, 271/12, 10.03, 10.06, 94, 99, 112, 132, 259, 271/265.01, 265.02, 270
See application file for complete search history.

(56) References Cited

U.S. PATENT DOCUMENTS

| | | | | |
|---|---|---|---|---|
| 3,995,851 | A | 12/1976 | Casper | |
| 4,451,028 | A * | 5/1984 | Holmes et al. | 271/11 |
| 4,621,798 | A | 11/1986 | Akers | |
| 4,657,236 | A * | 4/1987 | Hirakawa et al. | 271/99 |
| 4,673,175 | A * | 6/1987 | Morita | 271/10.03 |
| 4,940,224 | A * | 7/1990 | Couper | 271/263 |
| 5,050,859 | A * | 9/1991 | Paxon | 271/270 |
| 5,090,676 | A * | 2/1992 | Matsuno et al. | 271/12 |
| 5,109,987 | A | 5/1992 | Daboub et al. | |
| 5,224,695 | A * | 7/1993 | Svyatsky et al. | 271/110 |
| 5,313,253 | A * | 5/1994 | Martin et al. | 399/16 |
| 5,398,922 | A | 3/1995 | Malatesta | |
| 6,443,444 | B1 * | 9/2002 | Cera et al. | 271/108 |
| 6,607,193 | B2 * | 8/2003 | Nordling et al. | 271/99 |
| 6,679,491 | B2 | 1/2004 | Luebben et al. | |
| 7,568,696 | B2 * | 8/2009 | Henson | 271/270 |
| 7,600,755 | B1 * | 10/2009 | Rozenfeld et al. | 271/276 |
| 7,635,124 | B2 * | 12/2009 | Sardella | 271/10.06 |
| 7,658,374 | B2 * | 2/2010 | Yasukawa et al. | 271/111 |
| 2003/0038065 | A1 | 2/2003 | Pippin et al. | |
| 2008/0203655 | A1 * | 8/2008 | Bruhn et al. | 271/265.01 |

FOREIGN PATENT DOCUMENTS

JP 62167151 A * 7/1987

* cited by examiner

*Primary Examiner* — Stefanos Karmis
*Assistant Examiner* — Luis A Gonzalez
(74) *Attorney, Agent, or Firm* — Filip A. Kowalewski

(57) ABSTRACT

A pickoff system for removal of mail pieces one at a time from the end of a stack includes a pickoff belt mechanism, a sensor positioned to determine mail piece movement speed, and a measurement device determines belt movement speed during operation of the pickoff belt mechanism. A vacuum system includes a vacuum pump and a vacuum manifold positioned to apply suction to the mail piece in a direction that tends to hold the mail piece against the belt of the pickoff belt mechanism. A controller is configured to compare the belt movement speed and the mail piece movement speed during operation, and when mail piece movement speed is slower than belt movement speed, indicating slipping of the mail piece relative to the belt of the pickoff belt mechanism, the controller temporarily increases suction force applied to a mail piece being transported by the pickoff belt mechanism.

8 Claims, 3 Drawing Sheets

PICKOFF MECHANISM FOR MAIL FEEDER

TECHNICAL FIELD

The invention relates to feeding systems for automated mail sorting machines, in particular to an improved pickoff mechanism for a mail feeder.

BACKGROUND OF THE INVENTION

Pickoff mechanisms have been in use for decades in automated letter sorting machines such as MLOCR and DBCS machines used by the U.S. Postal Service and private presort bureaus, as described, for example, in U.S. Pat. Nos. 5,109,987 (Daboub) and 6,679,491 (Luebben et al). The feeder section of the machine includes an unloading table where mail for sorting is manually placed edgewise to form a stack. The stack is advanced incrementally towards the pickoff mechanism which functions to feed mail pieces one at a time into a pinch belt conveyor system for sorting.

Known pickoff mechanisms comprise a series of rubber belts wound over a drive roller and a follower roller. The belts engage the endmost mail piece of the stack and rely on friction to pull it sideways off of the stack and into the entry nip of the pinch belt conveyor. Friction is created by the pressure of the mail stack as it advances into contact with the pickoff belts. The stack is carried by a horizontal belt conveyor, and its remote end is supported by a paddle movably mounted on a frame of the feeder. The paddle and belt are synchronized to move the stack forward in increments. This is controlled by a letter present sensor, for example, a mechanical proximity switch using a spring arm which indicates to the feeder controller that the end of the stack is in engagement with the outer face of the pickoff belts.

Some known pickoff designs rely on keeping the stack under pressure against the pickoff belts to create sufficient friction so that the pickoff operation proceeds smoothly at high speed. In practice, mail pieces are not uniform and sometimes slip against the pickoff belts, delaying feeding of the mail piece to the pinch belts. To remedy this, vacuum-assisted pickoff mechanisms were devised wherein suction is applied to the endmost mail piece through holes in the belts. This prevents slipping of mail pieces to a greater extent, but not entirely. The problem becomes more difficult when the incoming mail in the stack includes mail pieces of different sizes and thicknesses, such that some require more frictional force to feed than others. Present pickoff mechanisms have no means of adjusting to compensate for variations in mail piece characteristics. The present invention seeks to remedy this limitation, and in so doing improved performance of the conveyor as a whole by improving throughput.

SUMMARY OF THE INVENTION

A pickoff system for removal of mail pieces one at a time from the end of a stack according to the invention includes a pickoff belt mechanism positioned to frictionally engage an outer surface of a mail piece at the end of the stack and transport it transversely to a thickness direction of the stack which mechanism includes one or more belts mounted on rollers and driven by a drive motor. A sensor is positioned to determine mail piece movement speed as it is being transported by the pickoff belt mechanism, and a measurement device determines belt movement speed during operation of the pickoff belt mechanism. A controller is connected to the sensor and the belt movement speed measurement device. The controller is configured to compare the belt movement speed and the mail piece movement speed during operation, and when mail piece movement speed is slower than belt movement speed, indicating slipping of the mail piece relative to the belt of the pickoff belt mechanism, the controller actuates a means for reducing slipping of the mail piece relative to the belt. A vacuum system is provided that includes a vacuum pump and a vacuum manifold connected to the vacuum pump. The vacuum manifold is positioned to apply suction to the mail piece in a direction that tends to hold the mail piece against the belt of the pickoff belt mechanism. The means for stopping slipping of the mail piece relative to the belt is one that temporarily increases friction between the mail piece and the belt by temporarily increasing suction force applied to a mail piece being transported by the pickoff belt mechanism.

The invention further provides a method for removal of mail pieces one at a time from the end of a stack. The method includes a step of frictionally engaging the outer surface of a mail piece at the end of the stack with a pickoff belt mechanism including one or more belts mounted on rollers driven by a drive motor, and thereby transporting the mail piece transversely to a thickness direction of the stack. Mail piece movement speed is determined with a mail piece movement speed sensor as the mail piece is being transported by the pickoff belt mechanism, and belt movement speed during operation of the pickoff belt mechanism is determined with a belt movement speed measurement device. The belt movement speed and the mail piece movement speed are compared during operation with a controller connected to the mail piece movement sensor and the belt movement speed measurement device. A step of temporarily increasing a suction force applied to a mail piece being transported by the pickoff belt mechanism is used to reduce slipping of the mail piece relative to the belt when the mail piece movement speed is slower than the belt movement speed, indicating slipping of the mail piece relative to the belt of the pickoff belt mechanism.

In a mail processing environment, the stack is typically supported edgewise on a conveyor belt that advances in increments as needed to bring an endmost (front) mail piece into contact with the belt of the pickoff belt mechanism. The foregoing method is especially useful when the stack contains mail pieces of varying dimensions. After pickoff, each mail piece is fed directly from the pickoff belt mechanism to a pinch belt conveyor such as is used in a postal sorting machine. These and other aspects of the invention are discussed further in the detailed description that follows.

BRIEF DESCRIPTION OF THE DRAWINGS

In the accompanying drawing, wherein like numerals denote like elements.

DETAILED DESCRIPTION

Figure 1:
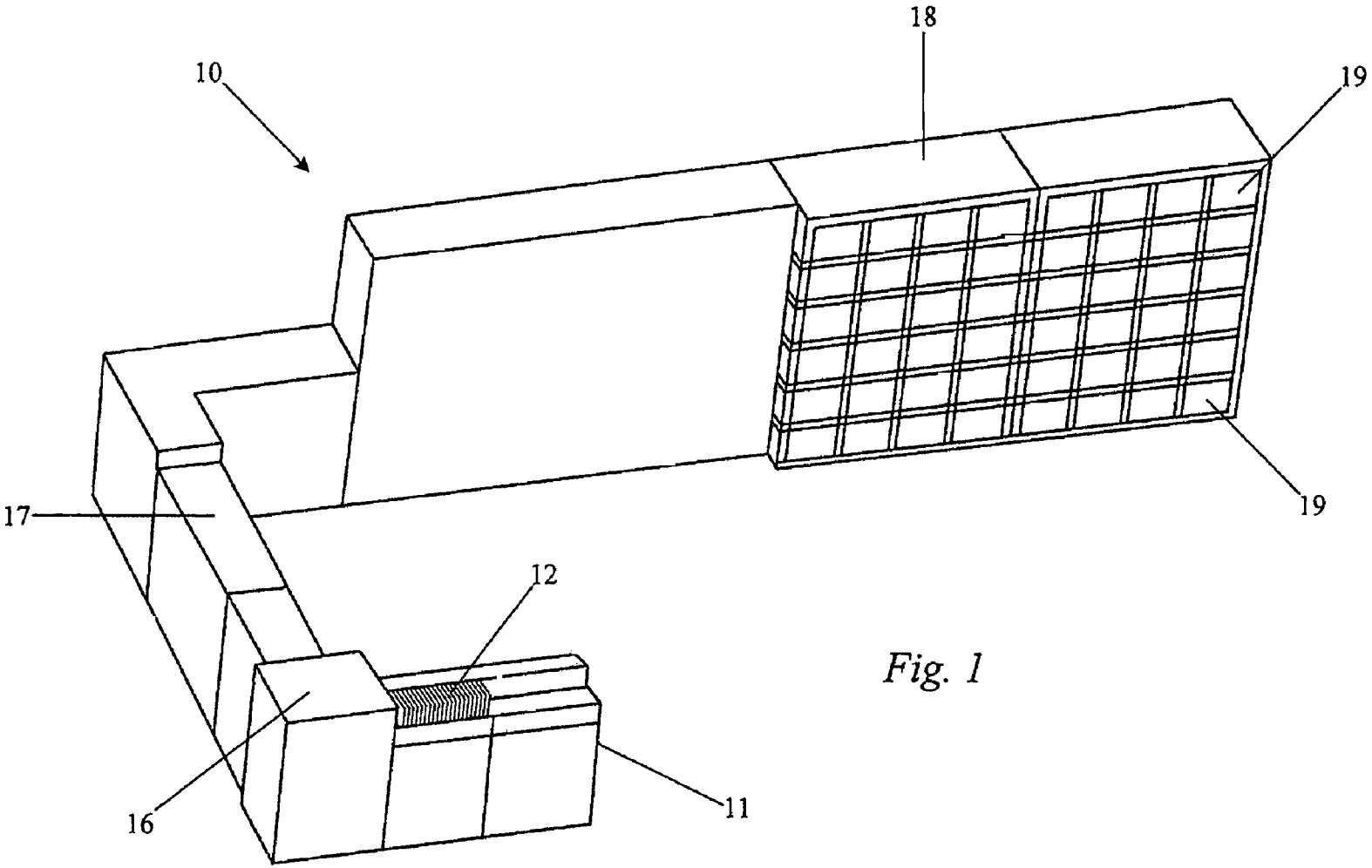
FIG. 1 is a perspective view of a mail sorting machine according to the invention.

Referring to FIG. 1, a mail sorting machine 10 such as a DBCS or MLOCR includes a mail feeder 11 upon which a stack 12 of unsorted mail pieces 13 are loaded for processing. Feeder 11 advances the stack 12 to a pickoff apparatus 16 that feeds a singulated stream of individual mail pieces through a transport section 17 to an automated sorting section or stacker 18 which sorts the mail in one or more passes to a plurality of bins or pockets 19. In transport section 17, each mail piece 13 is scanned for address information. For purposes of the invention, a "mail piece" is a letter, postcard or flat of a type that is commonly fed from the end of a stack one piece at a time into a sorting or other postal processing machine.

Figure 2:
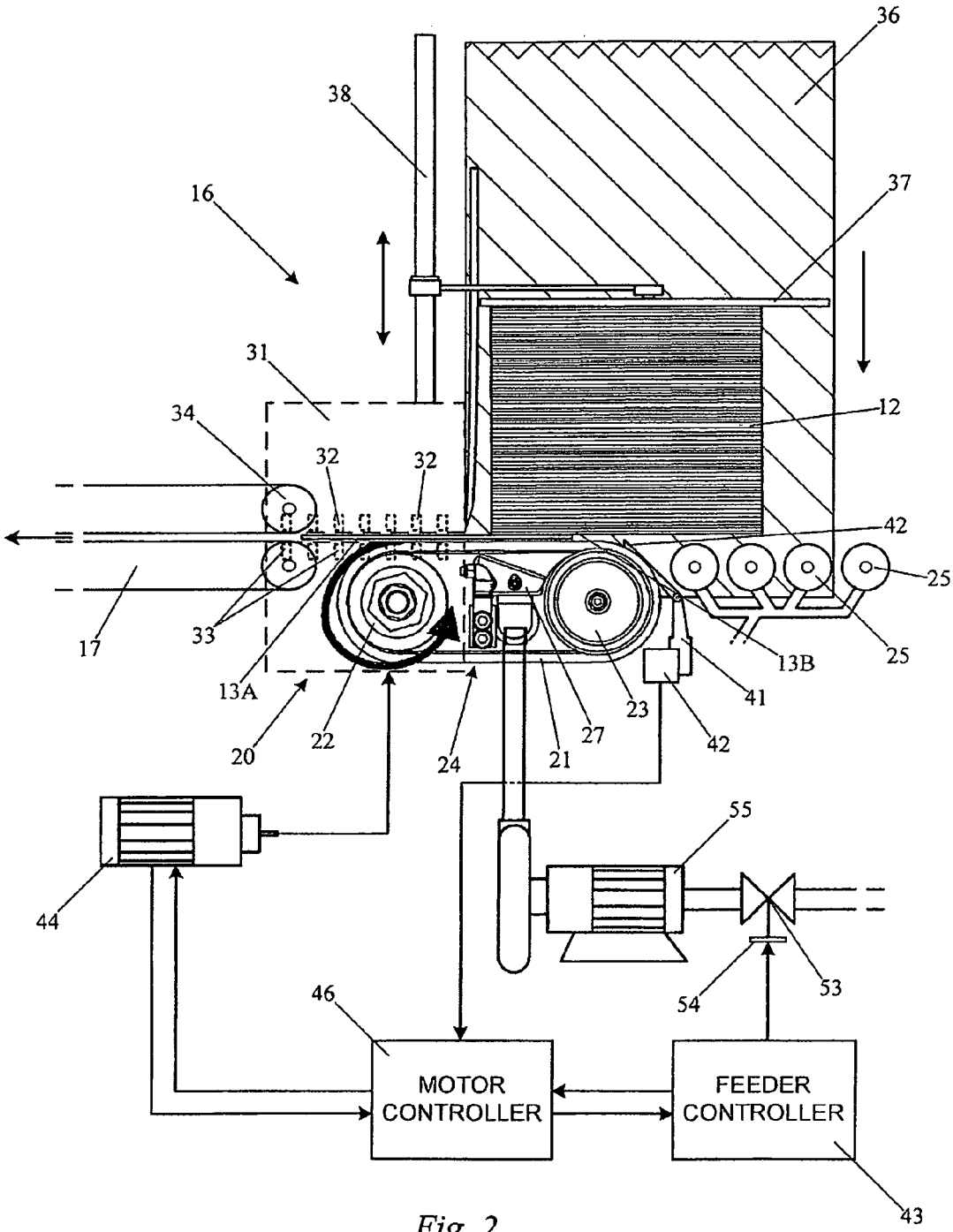
FIG. 2 is a schematic top view of a pickoff system used in the machine of FIG. 1.
Figure 3:
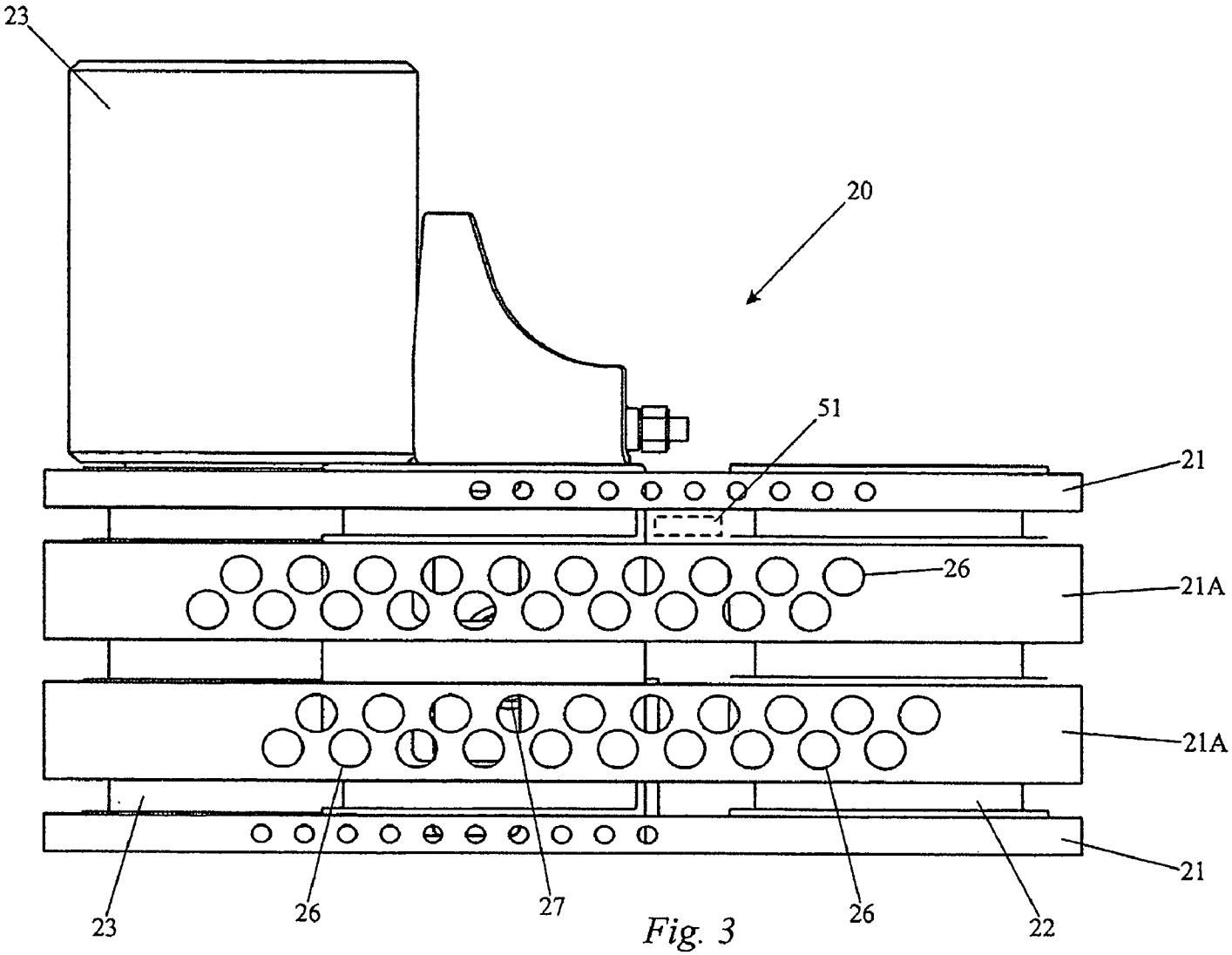
FIG. 3 is a front view of the pickoff belt shown in FIG. 2.

Referring to FIGS. 2-3, a vacuum pickoff 20 for use in sorter 10 has a set of vertically spaced rubber belts 21 wound over a drive roller 22 and a follower roller 23 to provide a generally racetrack-shaped pickoff belt mechanism 24. At least the middle belts 21A of the set have spaced holes 26 therethrough. A vacuum manifold 27 is presented inside the mechanism 24 between rollers 22, 23 and positioned so that suction is applied through middle belts 21A as they pass manifold 27, which suction is applied through holes 26 to a mail piece 13 at the leading end of the stack 12 to be sorted. A set of vertical guide rollers 25 rollingly support the right side of stack 12 which overhangs the end of pickoff belt mechanism 24 as shown in FIG. 2.

A light array sensor 31 includes a horizontal row of emitters 32 and a row of receivers 33 aligned with each emitter 32. Light array sensor 31 is positioned on opposite sides of the pickoff path bridging the transition shown between the pickoff belt mechanism 24 and takeaway pinch belt mechanism 34. Mail pieces 13 once engaged by the pinch belts are carried through transport section 17. The imaging camera used to read the bar code and/or printed address on each mail piece is just downstream from pickoff 20.

In operation, the stack of mail 12 is positioned on a horizontal carrier conveyor belt 36. The trailing end of the stack 12 is supported by a paddle 37 that is moved along a guide bar 38 in a manner known in the art to support the stack. The leading end of the stack 12 advances into contact with a pivoting arm mechanism 41 which, when actuated, triggers a contact switch (sensor) 42 that indicates to a system controller 43 that mail is in position for pickoff. Pivoting arm 41 and switch 42 are one form of letter present sensor that could be used.

Throughput in a mail sorter 10 is a function both of belt speed and maintaining consistent gap spacing between mail pieces moving on the pinch belt conveyor system 24. Slipping at the pickoff widens the gap between the mail piece 13 that slipped and the one immediately ahead of it in the mail stream, reducing throughput. Consistent gap spacing thereby improves throughput while maintain while maintaining the same belt speed, for example 4m/sec.

The present invention in one aspect seeks to detect when mail piece slippage occurs or starts to occur, and correct for it. Drive roller 22 of pickoff belt mechanism 24 is driven by an encoder-equipped electric motor 44. One way to measure slipping of a mail piece 13 is to measure the difference between the speed of the mail piece and the speed of the drive motor of the pickoff as measured by the encoder. Motor 44 sends a signal to a motor controller 46 indicating the motor speed in revolutions (rpm), and controller 46 relays the signal to feeder controller 43.

Mail piece speed can be measured in a number of ways. The existing light array sensor 31 is capable of tracking the leading or trailing edge of each mail piece 13 over a range of positions. The speed of the mail piece 13 can be determined as a function of time as the front edge of the mail piece 13 passes from one photocell pair 32, 33 to the next. This is transmitted to controller 43 and compared by controller 43 with the pickoff belt speed as determined from the motor encoder. If slippage is occurring, the mail piece speed will be less than (lagging relative to) the motor speed.

Other ways to measure belt speed include a contact or non-contact sensor deployed for that purpose. A tachometer could be built into the pickoff mechanism 20 so that a wheel 51 between belts 21 (or offset from the belts 21) engages the mail piece and directly measures its velocity as reflected by the peripheral velocity of the wheel. A non-contact doppler effect sensor could be positioned to determine the speed of the mail piece and would have the advantage of not physically affecting its movement (the tachometer wheel would create some additional friction.) A CMOS camera could be used in a similar manner to track frame movement of the mail piece over a range of positions.

Once the need to reduce slipping has been identified, a number of means can be used to correct the imbalance. One such means is to temporarily increase the suction force of the vacuum system so that the mail piece is no longer able to slip relative to the belts. As shown in FIG. 2, vacuum manifold 27 is connected to a vacuum pump 52. Pump 52 normally runs in a steady state drawing air through an intake line 55. According to this aspect of the invention, however, suitable means are provided so that the suction force applied through manifold 27 can vary under the control of feeder controller 43. Controller 43 is connected to a valve 53 in intake line 55 having an actuator 54 that allows valve to assume at least open and partly open positions. Valve 53 in this example is normally in a partly open position. When controller 43 receives signals indicating that a mail piece 13A is slipping, it signals actuator 54 to open valve 53 fully. This increases the suction force applied by vacuum manifold 27, thereby increasing friction between the belts 21 and mail piece 13A. Slipping should thereby be reduced or eliminated. Valve 53 is returned to its normal partly open position when the mail piece 13A has been engaged by pinch belt conveyor 34 as described below.

A variable speed vacuum pump under the control of controller 43 can be used as pump 52, or valve 53 may be one capable of assuming a range of partly open positions. In either case, a feedback loop can be established. If increasing the suction force to a certain extent does not result in equalization of the belt speed and the speed of the mail piece 13, then controller 43 further increases the suction force by signaling the variable speed vacuum pump to operate at a higher level, or by opening valve 53 further. In this manner, if the attempt to reduce slippage fails initially, then in a very short interval of time, additional action is taken to remedy the problem.

As mail piece 13A continues to move, its trailing edge will be detected by the progressive uncovering of the rightmost sets of photocell pairs 32, 33 shown in FIG. 2. The next mail piece 13B engages pickoff belt mechanism 24 and the cycle starts again as a signal from switch 42 indicates that the next mail piece 13B is ready for pickoff. If mail piece 13B behaves normally, then no change to the applied suction is made. The valve position may be reset to a predetermined starting position.

Although several embodiments of the present invention have been described in the foregoing detailed description and illustrated in the accompanying drawings, it will be understood by those skilled in the art that the invention is not limited to the embodiments disclosed but is capable of numerous rearrangements, substitutions and modifications without departing from the spirit of the invention. A controller for purposes of the invention may be a single control unit that operates the various components or two or more controllers that work together as described above. The valve described as partly opening the vacuum pump intake could be a set of 2-position valves each with its own intake line supply air to the vacuum pump, so that opening and closing some but not all of the valves creates greater or lesser suction at the belt surface. These and other modifications are within the scope of the invention as expressed in the appended claims.

The invention claimed is:

1. A pickoff system for removal of mail pieces one at a time from the end of a stack, comprising:

a pickoff belt mechanism positioned to frictionally engage an outer surface of a mail piece at the end of the stack and transport it transversely to a thickness direction of the stack, which mechanism includes one or more belts mounted on rollers and driven by a drive motor;

a sensor positioned to determine mail piece movement speed as the mail piece is being transported by the pickoff belt mechanism;

a measurement device for determining belt movement speed during operation of the pickoff belt mechanism;

a vacuum system including a vacuum pump and a vacuum manifold connected to the vacuum pump, wherein the vacuum manifold is positioned to apply suction to the mail piece in a direction that tends to hold the mail piece against the belt of the pickoff belt mechanism;

a valve positioned to regulate air intake to the vacuum pump;

an actuator that operates the valve;

a controller connected to the sensor and the belt movement speed measurement device, which controller is configured to compare the belt movement speed and the mail piece movement speed during operation, and when mail piece movement speed is slower than belt movement speed, indicating slipping of the mail piece relative to the belt of the pickoff belt mechanism, the controller actuating a controller function that transmits a signal to the valve actuator, which opens the valve in a manner that temporarily increases suction force applied to a mail piece being transported by the pickoff belt mechanism.

2. The system of claim 1, wherein the measurement device for determining belt movement speed comprises an encoder connected to the drive motor, which encoder continuously transmits a signal to the controller indicating the rotation speed of the drive motor, which rotation speed indicates the belt speed.

3. A pickoff system for removal of mail pieces one at a time from the end of a stack, comprising:

a pickoff belt mechanism positioned to frictionally engage an outer surface of a mail piece at the end of the stack and transport it transversely to a thickness direction of the stack, which mechanism includes one or more belts mounted on rollers and driven by a drive motor;

a sensor positioned to determine mail piece movement speed as the mail piece is being transported by the pickoff belt mechanism;

a measurement device for determining belt movement speed during operation of the pickoff belt mechanism;

a vacuum pump;

a vacuum manifold connected to the vacuum pump, wherein the vacuum manifold is positioned to apply suction to the mail piece in a direction that tends to hold the mail piece against the belt of the pickoff belt mechanism;

means for stopping slipping of the mail piece relative to the belt during transport by the belt pickoff mechanism by temporarily increasing suction force applied to a mail piece being transported by the pickoff belt mechanism; and a controller connected to the sensor and the belt movement speed measurement device, which controller is configured to compare the belt movement speed and the mail piece movement speed during operation, and when mail piece movement speed is slower than belt movement speed, indicating slipping of the mail piece relative to the belt of the pickoffbelt mechanism, the controller actuating the means for stopping slipping of the mail piece relative to the belt.

4. The system of claim 3, wherein the measurement device for determining belt movement speed comprises an encoder connected to the drive motor, which encoder continuously transmits a signal to the controller indicating the rotation speed of the drive motor, which rotation speed indicates the belt speed.

5. A method for removal of mail pieces one at a time from the end of a stack, comprising:

frictionally engaging the outer surface of a mail piece at the end of the stack with a pickoff belt mechanism including one or more belts mounted on rollers driven by a drive motor, and thereby transporting the mail piece transversely to a thickness direction of the stack;

determining mail piece movement speed with a mail piece movement speed sensor as the mail piece is being transported by the pickoff belt mechanism;

determining belt movement speed during operation of the pickoffbelt mechanism with a belt movement speed measurement device;

comparing the belt movement speed and the mail piece movement speed during operation with a controller connected to the mail piece movement sensor and the belt movement speed measurement device;

temporarily increasing a suction force applied to a mail piece being transported by the pickoff belt mechanism to reduce slipping of the mail piece relative to the belt when the mail piece movement speed is slower than the belt movement speed, indicating slipping of the mail piece relative to the belt of the pickoff belt mechanism.

6. The method of claim 5, further comprising:

supporting the stack edgewise on a conveyor belt; and advancing the conveyor belt in increments as needed to bring an endmost mail piece into contact with the belt of the pickoff belt mechanism.

7. The method of claim 5, wherein the stack contains mail pieces of varying dimensions.

8. The method of claim 5, further comprising feeding each mail piece directly from the pickoff belt mechanism to a pinch belt conveyor.

* * * * *